US007290858B2

(12) United States Patent
Furuichi et al.

(10) Patent No.: US 7,290,858 B2
(45) Date of Patent: Nov. 6, 2007

(54) INK JET PRINTING METHOD AND INK JET PRINTING APPARATUS

(75) Inventors: Tomomi Furuichi, Kanagawa-ken (JP); Rie Takekoshi, Kanagawa-ken (JP); Daigoro Kanematsu, Kanagawa-ken (JP); Naoko Baba, Kanagawa-ken (JP); Kazuo Suzuki, Kanagawa-ken (JP); Mitsutoshi Nagamura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 253 days.

(21) Appl. No.: 11/150,125

(22) Filed: Jun. 13, 2005

(65) Prior Publication Data

US 2005/0275687 A1 Dec. 15, 2005

(30) Foreign Application Priority Data

Jun. 15, 2004 (JP) ..... 2004-177373

(51) Int. Cl.
*B41J 2/205* (2006.01)

(52) U.S. Cl. ..... 347/43; 347/15; 347/29

(58) Field of Classification Search ..... 347/15, 347/43, 29, 33, 41, 30, 35
See application file for complete search history.

(56) References Cited

U.S. PATENT DOCUMENTS 6,984,009 B2 * 1/2006 Nakagawa et al. ..... 347/9
7,014,292 B2 * 3/2006 Yazawa et al. ..... 347/29
7,029,092 B2 * 4/2006 Edamura et al. ..... 347/30

FOREIGN PATENT DOCUMENTS

JP 55-139269 10/1980

* cited by examiner

*Primary Examiner*—Lamson Nguyen
(74) *Attorney, Agent, or Firm*—Fitzpatrick, Cella, Harper & Scinto

(57) ABSTRACT

The image quality deterioration due to the collection of dots of low-lightness by the preliminary ejection is prevented, in the case of performing the ink ejection for preliminary ejection during the printing onto printing paper. More specifically, the preliminary ejection pattern is set as a pattern in which the distance between a cyan dot of relatively low-lightness and a magenta dot is longer than a distance between a yellow dot of relatively high-lightness and a cyan dot nearest the yellow dot among low-lightness colors. Closely forming dots of low-lightness that would be perceived as a group of collected dots can be prevented, thereby performing printing that will not deteriorate the printing quality due to the paper preliminary ejection.

8 Claims, 14 Drawing Sheets

DEVELOPMENT PATTERN OF INDEX LEVEL "0001"

INK JET PRINTING METHOD AND INK JET PRINTING APPARATUS

BACKGROUND OF THE INVENTION

Field of the Invention

The present invention relates to an ink jet printing method and an ink jet printing apparatus and, more particularly, to an ink jet printing method and an ink jet printing apparatus for performing so-called preliminary ejection, in which ink is ejected from a printing head for taking no part of printing, is performed while printing an image.

Also, the present invention can be applied to apparatuses such as a printer, a copying machine, a facsimile machine having a communication system, a word processor having a printer section and so on for printing on a medium to be printed such as paper, yarn, fiber, fabric, metal, plastic, rubber, glass, wood, ceramics and so on and, moreover, industrial printing apparatuses combined complexly with various processing units.

It should be appreciated that "printing" in the present specification means not only to afford images having a meaning such as characters and graphics to the medium to be printed, but also to afford images having no meaning such as patterns.

DETAILED DESCRIPTION OF THE RELATED ART

The preliminary ejection in an ink jet printer is performed to discharge highly viscous ink and dust in an ink ejection orifice of a printing head through ink ejection thereof so as to keep the ejection performance of the printing head satisfactory. It is also executed for avoiding density unevenness on a printed image by ejecting ink whose concentration of color material such as dye and pigment has increased. Usual manners of such preliminary ejection include, in the case of a serial method of printing by causing the printing head to scan, the ink ejection is performed, for the preliminary ejection, to an ink receptacle disposed at one end of the scanning area. Further, in the case of a full line method for printing by moving a printing medium with respect to a printing head whose ink ejection orifices are arranged in correspondence to the width of the printing medium, the ink receptacle is moved relatively to the printing head to oppose thereto and ink is ejected to the same.

On the other hand, those of which ink is ejected for the preliminary ejection while an image is printed on the printing medium are also known. For instance, it is described to perform the preliminary ejection at a constant frequency for the ink ejection for printing, in Japanese Patent Application Laid-Open No. 1980-139269. According to such preliminary ejection, it is not necessary for the printing head to move for preliminary ejection as in the case of performing the preliminary ejection to a predetermined ink receptacle disposed in the printer. Therefore, it becomes possible to prevent the throughput of printing from lowering as much. Even when the ejection is not performed for certain ejection orifices during the printing in relation with the printing data, the preliminary ejection can be performed for these ejection orifices, because this method for performing the preliminary ejection to the printing medium (also referred as "paper preliminary ejection" in the present specification) is performed, basically, accompanying the ink ejection for printing an image. More specifically, during the printing, the printing is performed in a state where the printing head is not covered with a cap or the like and the ejection orifice part is exposed, and in this case, even when the ejection is not performed for certain ejection orifices according to the printing data, the ink ejection through preliminary ejection can be performed for these ejection orifices, allowing to effectively prevent ejection failure due to the exposed state.

Particularly, the paper preliminary ejection is effective in the case of printing on a relatively large sized printing medium. More specifically, in the case of printing on a large sized printing medium, the throughput tends to lower because as much time is necessary for the printing head to scan. The paper preliminary ejection is a method desirable for preventing the throughput from lowering. In addition, when printing on a large sized printing medium, the ejection orifice in the printing head remains exposed for a long period of time. However, the paper preliminary ejection is preferable as a method allowing ejecting of ink during this exposed state.

Furthermore, without limiting to the case of using the large sized printing medium, the paper preliminary ejection is preferable as a method allowing to eject ink for the printing head in the exposed state, when the ink uses pigment or the like, for instance, as a color agent and tends to become highly viscous by coagulation.

However, the paper preliminary ejection sometimes degrades the image quality for usual ink jet printers in which the printing is performed using a plurality of ink colors. For example, ink dots of a plurality of low-lightness colors are sometimes formed on the printing medium in a concentrated manner, in the case of performing the paper preliminary ejection for each one of a plurality of ink colors at a constant frequency, as described in Japanese Patent Application Laid-Open No. 1980-139269. These concentrated dots of the plurality of low-lightness colors are so conspicuous as they are perceived by a viewer of the printed image, and then the printed image is degraded.

SUMMARY OF THE INVENTION

The present invention can provide an ink jet printing method and an ink jet printing apparatus which can perform paper preliminary ejection that would not bring the deterioration of image quality due to dots of low-lightness colors.

In the first aspect of the present invention, there is provided an ink jet printing method that uses a printing head for ejecting a plurality of colors of ink on a printing medium to perform printing, in which the plurality of colors of ink are ejected on the printing medium for preliminary ejection in conjunction with ink ejection for the performance of printing, the method comprising:

step for generating print data by adding preliminary ejection data for the preliminary ejection to print data based on an image to be printed; and step for ejecting the plurality of colors of ink on the printing medium from the printing head, based on the generated print data, wherein a dot pattern of the plurality of colors of ink formed based on the preliminary ejection data is a pattern having a relation that a distance between any two dots other than a dot of highest-lightness is longer than a distance between a dot nearest to the dot of highest-lightness and a dot of highest-lightness, among the plurality of colors of dots.

In the second aspect of the present invention, there is provided an ink jet printing apparatus that uses a printing head for ejecting a plurality of colors of ink on a printing medium to perform printing, in which the plurality of colors of ink are ejected on the printing medium for preliminary ejection in conjunction with ink ejection for the performance of printing, the apparatus comprising:

generating means for generating print data by adding preliminary ejection data for the preliminary ejection to print data based on an image to be printed; and ejection means for ejecting the plurality of colors of ink on the printing medium from the printing head, based on the generated print data, wherein a dot pattern of the plurality of colors of ink formed based on the preliminary ejection data is a pattern having a relation that a distance between any two dots other than a dot of highest-lightness is longer than a distance between a dot nearest to the dot of highest-lightness and a dot of highest-lightness, among the plurality of colors of dots.

According to the above structure, the dot pattern formed based on preliminary ejection data is a pattern having a relation that the distance between any two dots other than the dot of highest-lightness is longer than the distance between a dot nearest to the dot of highest-lightness and the dot of highest-lightness, among a plurality of color dots. Therefore, the interval between low-lightness color dots can be set longer, and then the dot pattern preventing these dots from being perceived as a group of collected dots can be designed easily. More specifically, when the patterns are designed under a condition to arrange a plurality of color dots in an area of a predetermined length, the interval between low-lightness color dots can be set longer than that in a pattern in which respective dots are arranged equally spaced. The predetermined length in the above condition can be determined as a length obtained by deriving the quantity of preliminary ejection (the number of times of ejection) necessary for a single scanning for one color ink during the printing for instance on printing paper of A3 format, based on viscosity increasing property of ink, scanning speed of the printing head, and the like, and dividing the width of the scanning direction of the A3 format printing paper by this number of times of ejection.

The printing can be realized without deteriorating the printing quality by the paper preliminary ejection, because forming dots which are perceived as a group of collected dots is prevented by using a preliminary ejection pattern as mentioned above.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of the present invention will be described in detail referring to accompanying drawings. A printer shall be illustrated as an ink jet printing apparatus, in the embodiments described below.

Figure 1:
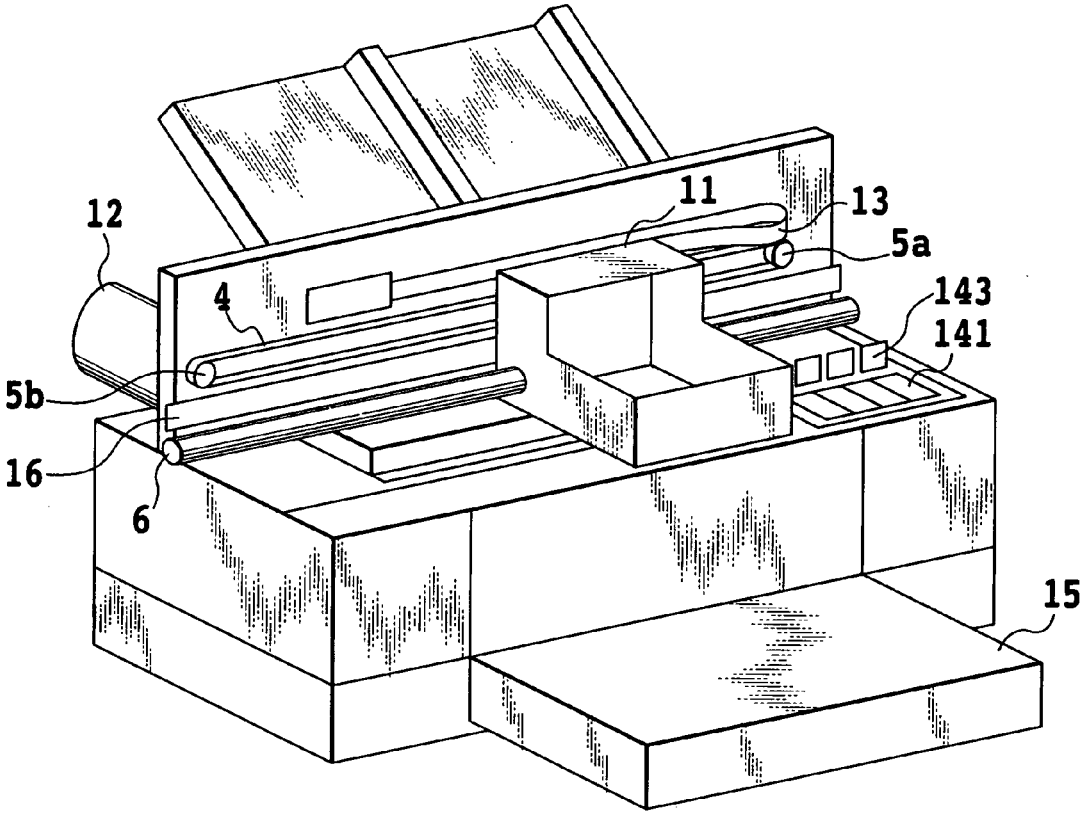
FIG. 1 is an exterior perspective view showing a schematic composition of an ink jet printer according to one embodiment of the present invention.

FIG. 1 is an exterior perspective view showing a schematic composition of an ink jet printer according to one embodiment of the present invention. As illustrated, in the printer, a printing head scans a printing medium through back-and-forth motion (this moving direction is referred as "main scanning direction") of a carriage 11 detachably mounting a head cartridge integrating the printing head and an ink tank for storing ink. During this scanning, the printing is performed by ejecting ink on a printing medium such as printing paper. A carriage motor 12 constitutes a driving source for moving the above carriage 11, and the driving force thereof is transmitted to the carriage via a belt 4 and pulleys 5*a*, 5*b*. A guide shaft 6 guides and supports the carriage 11 when it moves in the main scanning direction. An ejection signal or the like for ink ejection by the printing head is transferred to the printing head as an electric signal from a control section mentioned below in FIG. 4, by intermediate of a flexible cable 13. A cap 141 and a wiper blade 143 perform capping and wiping of the printing head respectively, and they are used for ejection recovery operation. A cassette 15 stocks printing medium (for instance, printing paper) in a layered state, while an encoder sensor 16 and an encoder film read optically the moving position of the carriage 11.

Figure 2:
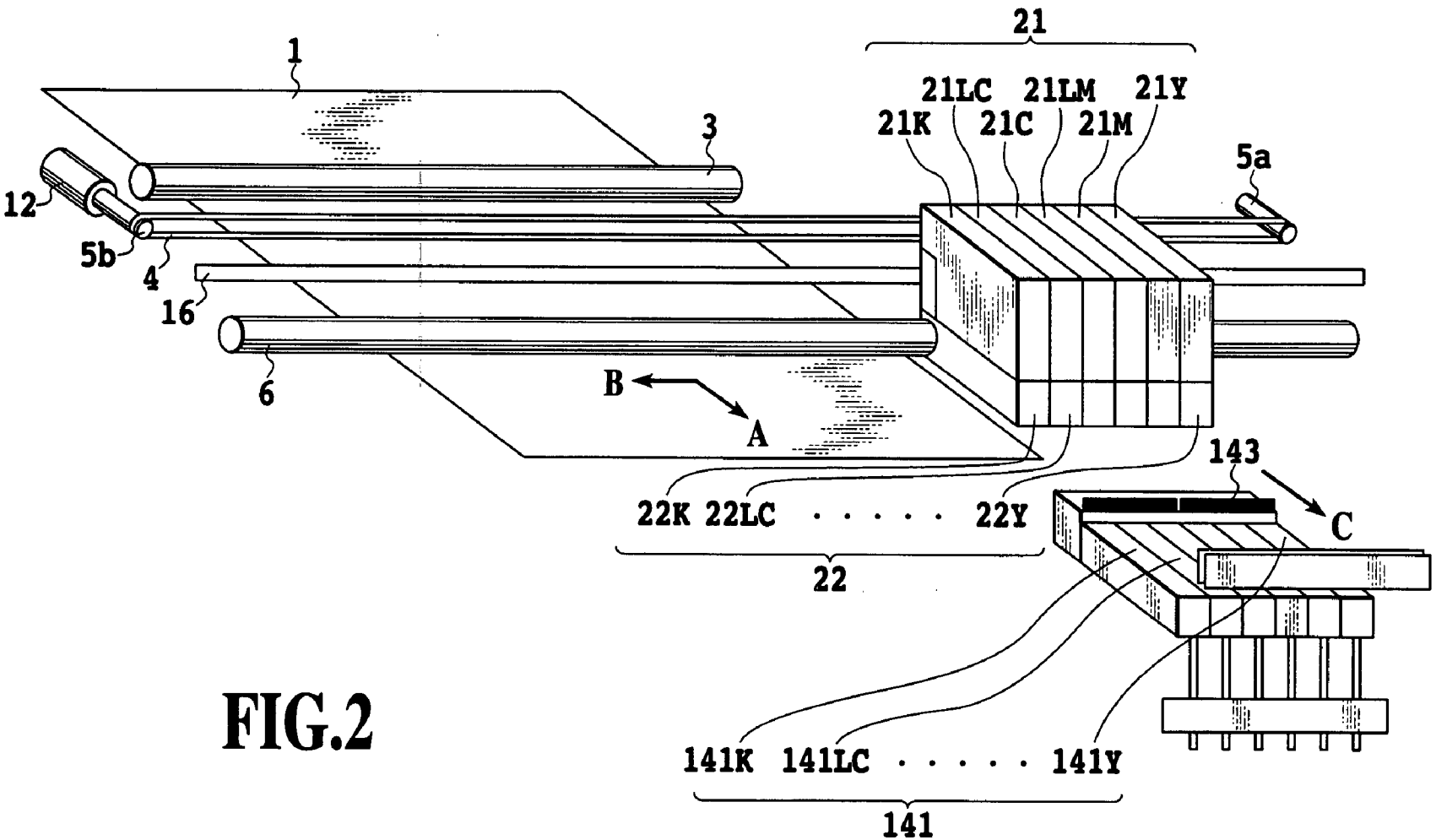
FIG. 2 is a perspective view showing in detail a composition of vicinity of the carriage in the ink jet printer shown in FIG. 1.

FIG. 2 is a perspective view showing in detail a composition of a vicinity of the carriage in the ink jet printer shown in FIG. 1. In FIG. 2, the printing head 22 is composed integrally with the ink tank as mentioned above, and mounted detachably on the carriage 11 in the present embodiment. There, this printing head 22 is composed of six printing heads 22K, 22C, 22M, 22Y, 22LC and 22LM ejecting six inks respectively in total including black (K), dark cyan (C), dark magenta (M) and yellow (Y) as well as light cyan (LC) and light magenta (LM) of lower colorant concentration than dark inks mentioned above. The ink tank 21 is composed of six ink tanks 21K, 21LC, 21C, 21LM, 21M, 21Y for storing ink to be fed to the respective printing heads 22K, 22LC, 22C, 22LM, 22M, 22Y. And, the respective printing heads and ink tanks are formed integrally for each ink of their corresponding colors to compose a head cartridge. Caps 141 corresponding six colors of inks, at the home position in the vicinity of one end of the moving range of the carriage 11 equipped with these cartridges. More specifically, the cap is composed of six caps 141K, 141LC, 141C, 141LM, 141M and 141Y so as to cover respective ink ejection faces of the six printing heads. It should be appreciated that these reference numbers given to respective ones are used for referring separately to these printing heads or ink tanks, and collective reference numbers such as "22" for the printing head, "21" for the ink tank and "141" for the cap are used where they are referred to comprehensively. It goes without saying that the printing head and the ink tank may also be detachable individually with respect to the carriage, though they are composed an integral head cartridge in the aforementioned example.

Figure 3:
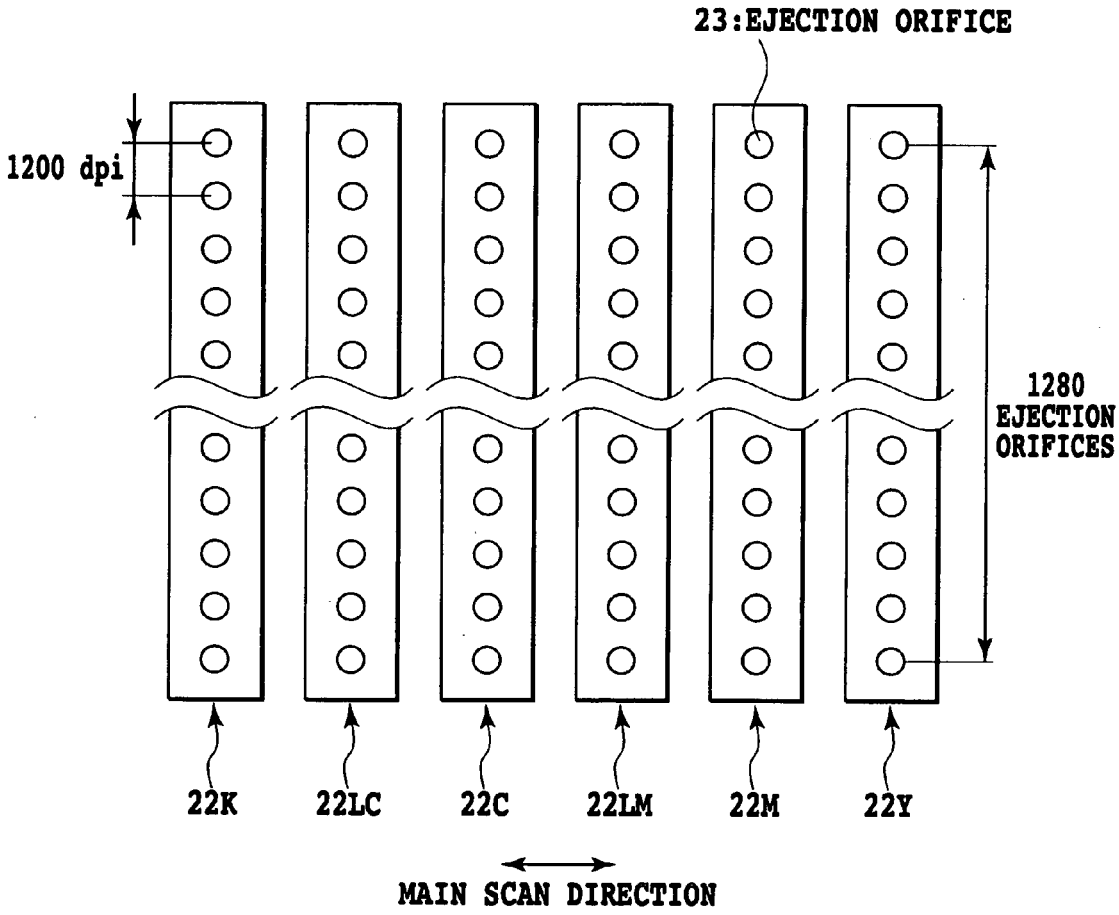
FIG. 3 is a diagram showing the printing head of FIG. 2 viewed from the ejection orifice side.

FIG. 3 is a diagram showing the printing head 22 viewed from the ejection orifice side. As shown in FIG. 3, printing heads 22K, 22LC, 22C, 22LM, 22M, 22Y have 1280 ejection orifices disposed approximately orthogonal to the main scanning direction with a density of 1200 dpi respectively. These six printing heads are mounted on the carriage 11 in a way to be arranged in the main scanning direction. Ink amount of about 4 ng is ejected at one time of ejection from each of ejection orifices 23.

The printing operation of the ink jet printer of the present embodiment described above referring to FIG. 1 to FIG. 3 is generally as follows.

When printing starts, printing papers 1 stacked in the cassette 15 are fed one by one to a printing area by a paper feed roller (not shown). Then, the printing head 22 scans in the printing area, and the printing paper is fed by a predetermined amount by a pair of transport rollers 3, on a platen (not shown) installed in an area to which the printing head 22 faces. On the other hand, ink is fed from the ink tank 21 to the printing head 22 and the printing head 22 ejects the ink on the printing paper 1 based on printing data, while scanning in the arrow B direction (forth scanning direction) of FIG. 2 to perform printing in a width corresponding to a predetermined number of ejection orifices of the printing head 22. Ink ejection in this printing is performed by driving the printing head according to the read timing of the encoder 16. Then, when the printing corresponding to one scan in the arrow B direction (forth scanning direction) is completed, the printing head 22 returns to the original home position and prints again in the arrow B direction (forth scanning direction). After the completion of one printing operation (one scan) in one direction, the printing paper 1 is fed in the arrow A direction by the predetermined amount which is the width corresponding to the predetermined number of the aforementioned ejection orifices by driving the pair of transport rollers 3, before the next printing operation starts. An image is printed on the printing paper 1 by repeating the printing operation of one scan and the feeding the paper by the predetermined amount in this manner.

The printing head 22 returns to the home position at a predetermined timing such as that before starting the printing, and performs a recovery operation by a recovery mechanism. More specifically, the ejection orifice face of the printing head 22 is capped with the cap 141 and ink in the ejection orifice 23 is sucked. Also, the above capping is performed during the non-printing, to prevent the ink from drying. Moreover, a wiper blade 143 wipes the ejection orifice 23 face of the printing head 22 by moving in the arrow C direction, to remove the ink attached to the ejection orifice face.

Further, as described later for FIG. 7, paper preliminary ejection, for ejecting ink on the printing paper along with the printing operation is performed as preliminary ejection in the embodiment of the present invention. Moreover, an ink receptacle is installed at a position adjacent to the home position in order to perform the preliminary ejection before starting the printing and so on in the present embodiment, and the preliminary ejection is performed at a predetermined timing such as that before the printing start.

Figure 4:
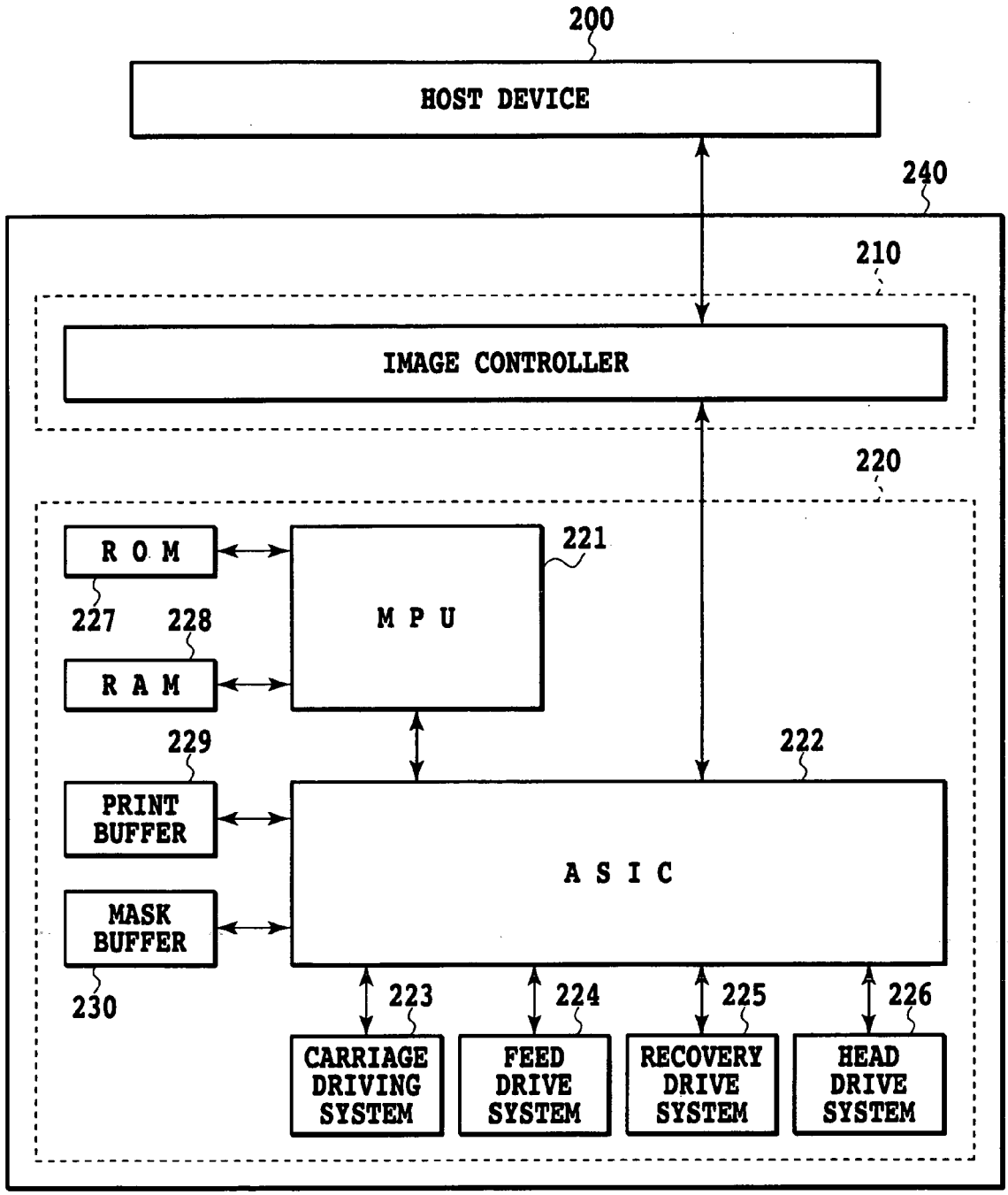
FIG. 4 is a block diagram showing a configuration of the control system in the ink jet printer of the present embodiment.

FIG. 4 is a block diagram showing a configuration of the control system of the ink jet printer of the present embodiment described above. In FIG. 4, an image controller 210 notifies a print engine control section 220 of a control command according to the processing command signal from a host device 200 or an operation section of a printer (not shown). Moreover, during the printing, printing data received from the host device 200 is analyzed, developed and converted into binary image data for respective colors. The print engine control section 220 performs the printing operation based on the control command and the image data sent from the image controller 210. The image controller 210 and the print engine control section 220 are connected by a dedicated interface, allowing to perform a communication comprising the command transmission for notifying a control command from the image controller 210 to the print engine control section 220 and the status transmission for informing of the state variation of the image controller 210 from the print engine control section 220, and the image data transfer from the image controller 210 to the print engine control section control section 220.

In the print engine control section 220, an MPU (Micro Processor Unit) 221 executes various operations, according to programs stored in a ROM 227. A RAM 228 is served as a working area and a temporary data storage area of the MPU 228. The MPU 221 controls a carriage driving system 223, a feed drive system 224, a recovery drive system 225 and a head drive system 226 via an ASIC (Application Specific Integrated Circuit) 222. Also, the MPU 221 is composed to read and write a print buffer 229 and a mask buffer 230 that can be read and written from the ASIC 222.

The print buffer 229 temporarily stores those image data converted into a format to be transferred to the printing head. The mask buffer 230 temporarily holds a predetermined mask pattern for exerting the AND processing to the data as necessary for multi-path printing when transferring from the print buffer 229 during the transfer to the printing head. It should be appreciated that several sets of mask patterns are available in the ROM 227 for multi-path printing different in the number of paths, a concerned mask pattern is read out from the ROM 227 during the actual printing, to be stored in the mask buffer 230. The AND processing with the mask buffer 229 is composed not to be executed when unnecessary as in the case of a single path printing.

In the aforementioned composition, the printing operation starts when image data are sent from the host device 200 to the image controller 210. The image controller 210 analyzes the image data received from the host device 200, generates printing quality, margin information or other information necessary for printing and moreover analyzes and develops the image data for starting the conversion into the binary image data of respective colors. Along with the development processing of these image data, information necessary for printing by the print engine control section 220 such as printing quality and margin information is transmitted to the print engine control section 220. Then, in the print engine control section 220, this transmitted information is processed by the MPU 221 via the ASIC 222 and held by the RAM 228. Thereafter, this information is referred to as necessary and used for segmenting the process. Furthermore, the mask pattern is written in the mask buffer 230 as necessary.

When the notification of necessary information is terminated, the image controller 210 starts to transfer the binary printing data of respective colors converted from the image data to the print engine control section 220. The print engine control section 220 writes the transferred printing data in the print buffer 229. And, as will be described later in FIG. 7, the OR (logical sum) of these written printing data and preliminary generated data for paper preliminary ejection is obtained to generate new printing data. The paper preliminary ejection can be performed during the printing, by printing based on the printing data to which these preliminary ejection data are added. Printing data to be transferred to the printing head is held successively in the print buffer 229 of the print engine control section 220, by repeating such printing data transfer from the image controller 210.

When the printing data held in the print buffer 229 attains such a quantity that allows printing the actual band data, the MPU 221 makes the paper transported by the carrying drive system 224 via the ASIC 222 and at the same time, moves the carriage 11 by the carriage driving system 223. Also, the recovery system is driven by the recovery drive system 225 for performing the recovery operation necessary before the printing operation. Furthermore, image output position and others are set for the ASIC 222 and the carriage 11 is driven to start the printing operation. When the carriage 11 moves and attains the printing start position set in the ASIC 222, printing data to which the aforementioned paper preliminary ejection pattern is added are read consecutively from the print buffer 229, in accordance with the ejection timing. Corresponding mask patterns are read from the mask buffer 230 as necessary. Then the AND (logical product) of the printing data read out and the mask data is determined and transferred to the printing head. In the printing head, the ejection is performed by driving the printing head according to the transferred data, under the control of the head driving system 226. Thus, for instance, a printing of one page is performed by repeating the processing of receiving the printing data from the image controller 210 and thereafter.

Figure 5:
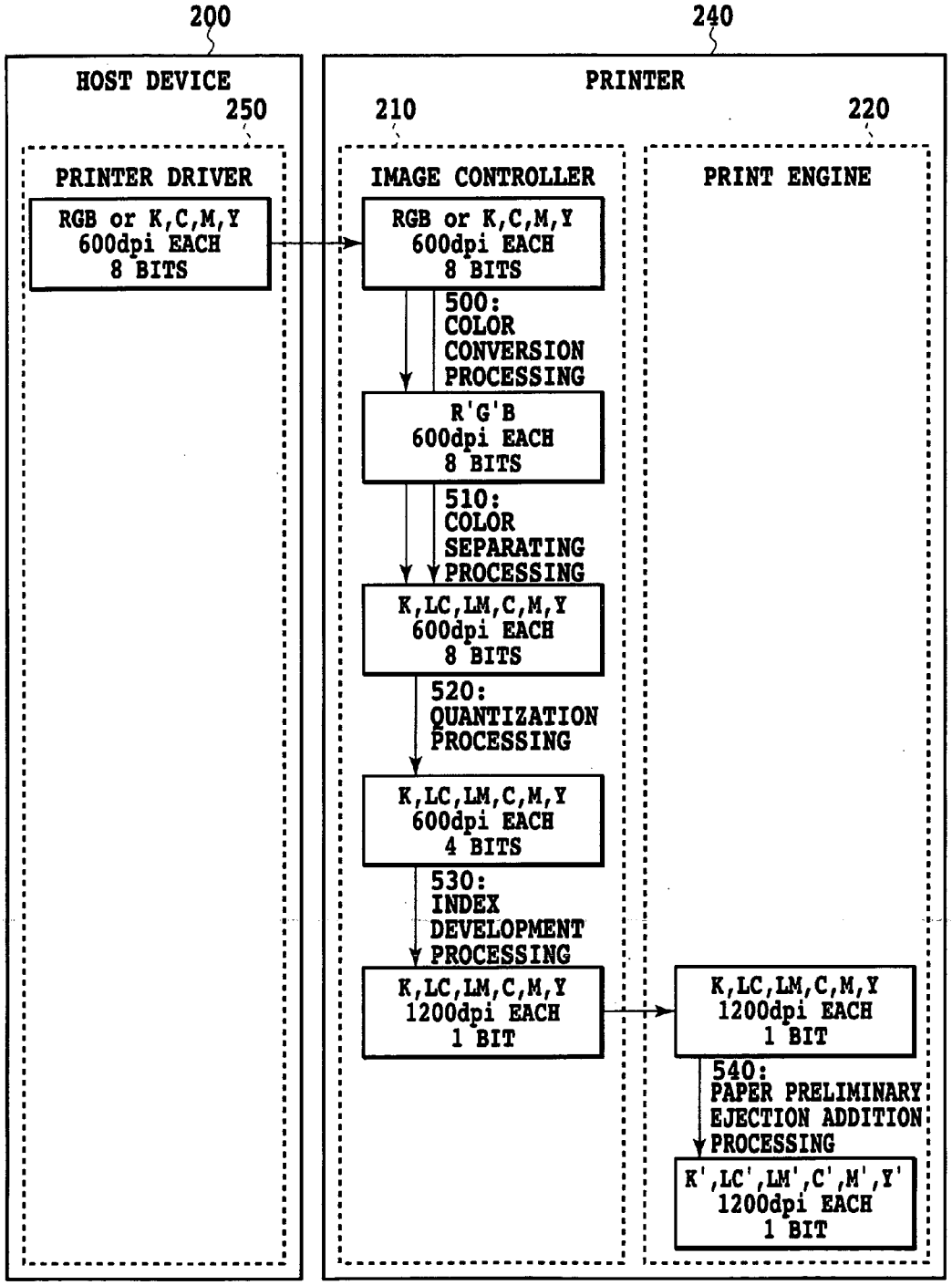
FIG. 5 is a diagram illustrating data processing in the host-device 200 and the printer 240 mentioned in FIG. 4.

FIG. 5 is a diagram illustrating data processing in the host device 200 and the printer 240 described above in FIG. 4.

A printer driver 250, software for controlling the printer is preliminarily installed in the host device 200, and activated when a user intends to print a desired image. First, the printer driver 250 generates multi-value image data (here, respectively 8 bits) in RGB (red, green, blue) or KCMY (black, cyan, magenta, yellow) format of 600 dpi×600 dpi and transfers them to the printer. If the received image data are of RGB format, the image controller 210 performs a color conversion processing 500 from RGB to R'G'B' in order to render a color space appropriate for the printer. Next, a color separating processing 510 is performed respectively from 8-bit data of R'G'B' to multi-value data (here, respectively 8 bits) of K, LC, LM, C, M, Y of 600 dpi×600 dpi for adapting to the ink color used by the printer. On the other hand, if data received by the image controller 210 are of KCMY format, a color separating processing 510 is performed without performing the color conversion processing 500. Thus, respective color data corresponding to the ink color to be used by the printer is generated in the color conversion processing 510 independently of the data format generated by the printer driver 250. Colors are converted by means of a look-up table for a predetermined color conversion, in the color conversion processing 500 and the color separating processing 510. The look-up table may be held preliminarily in ROM data in a printer main body, the processing may also be executed based on the table transferred from the host device 200 with the printing data.

Following this, a quantization processing 520 from 8-bit (255 gradation values) data of K, LC, LM, C, M, Y to 4-bit (5 gradation values) for respective colors is performed. The quantization processing 520 is performed by using publicly known error dispersion method or dither method. The 4-bit (5 gradation values) data of quantized K, LC, LM, C, M, Y is submitted to an index development processing 530 mentioned below in FIG. 6, and converted into printing data of 1-bit (2 gradation values) for respective colors of K, LC, LM, C, M, Y. The converted printing data are transferred to the print engine control section 220.

Figure 6:
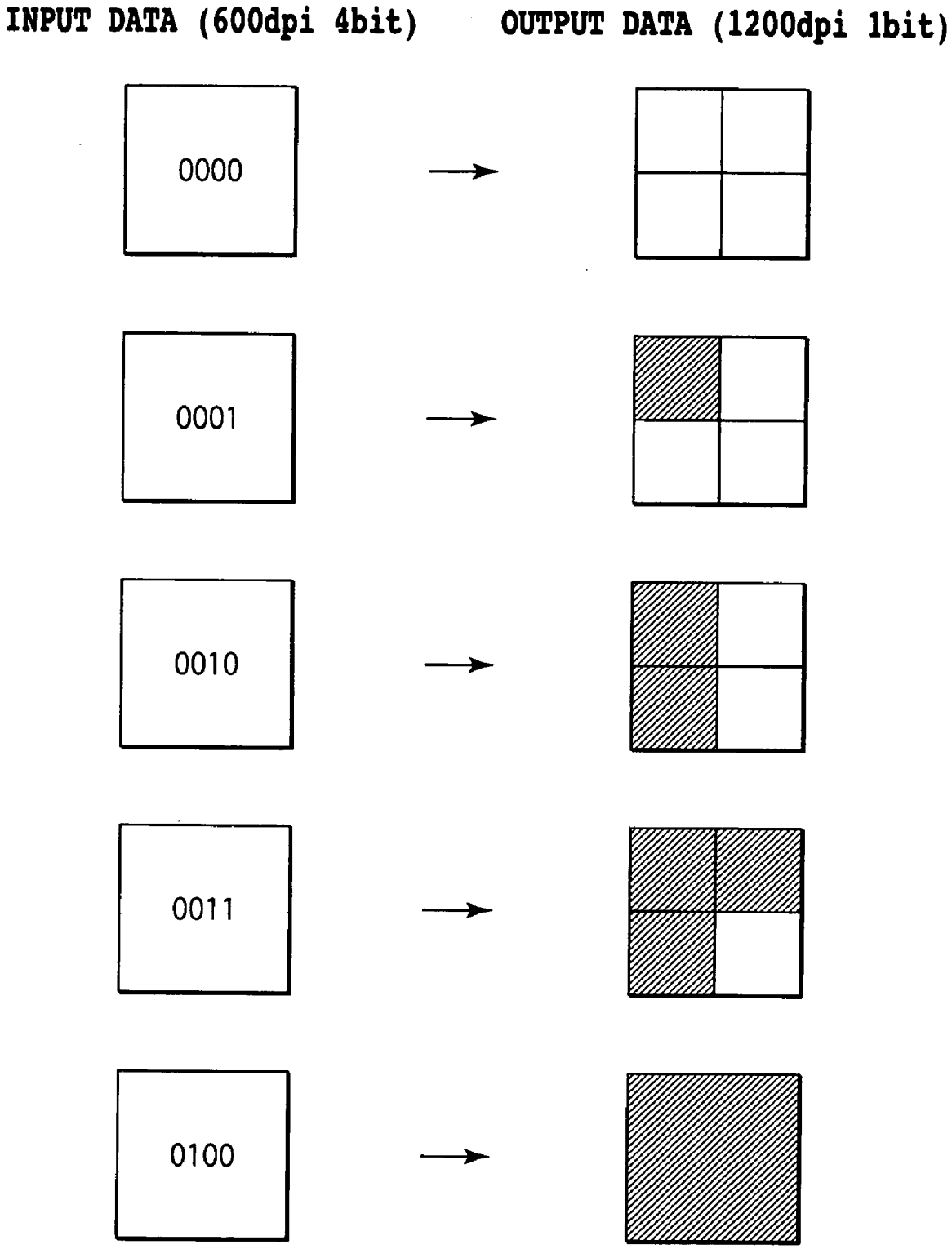
FIG. 6 is a diagram illustrating an index development shown in FIG. 5.

FIG. 6 is a diagram illustrating the index development described above. In general, the index development has an object to reduce the processing load in the RGB multi-value data phase and, at the same time, improve the graduation and, thereby, permits to assure the compatibility of processing speed and image quality. In the present embodiment, the image controller 210 submits 4 bit (5 gradation values) data of 600 dpi to the index development to obtain 1-bit (2 gradation values) data of 1200 dpi. Consequently, the matrix size to be developed is 2 (lateral)×2 (vertical). As illustrated, a pattern to be developed by 4-bit data ("0000", "0001", "0010", "0011", "0100") for 5 gradation values is set beforehand for the same. This setting pattern may be held in the ROM of the printer, or, downloaded from the host device together with the image data. 4-bit data of 600 dpi are developed by pixel unit based on the pattern of respective graduation level sets as mentioned above, to generate 1-bit (2 gradation values) data of 1200 dpi. In the print engine control section 220 preliminary ejection data are added as paper preliminary ejection generated beforehand as described later by OR (logical sum) to the data of 1-bit (2 gradation values) for respective colors of thus developed K, LC, LM, C, M, Y.

Figure 7:
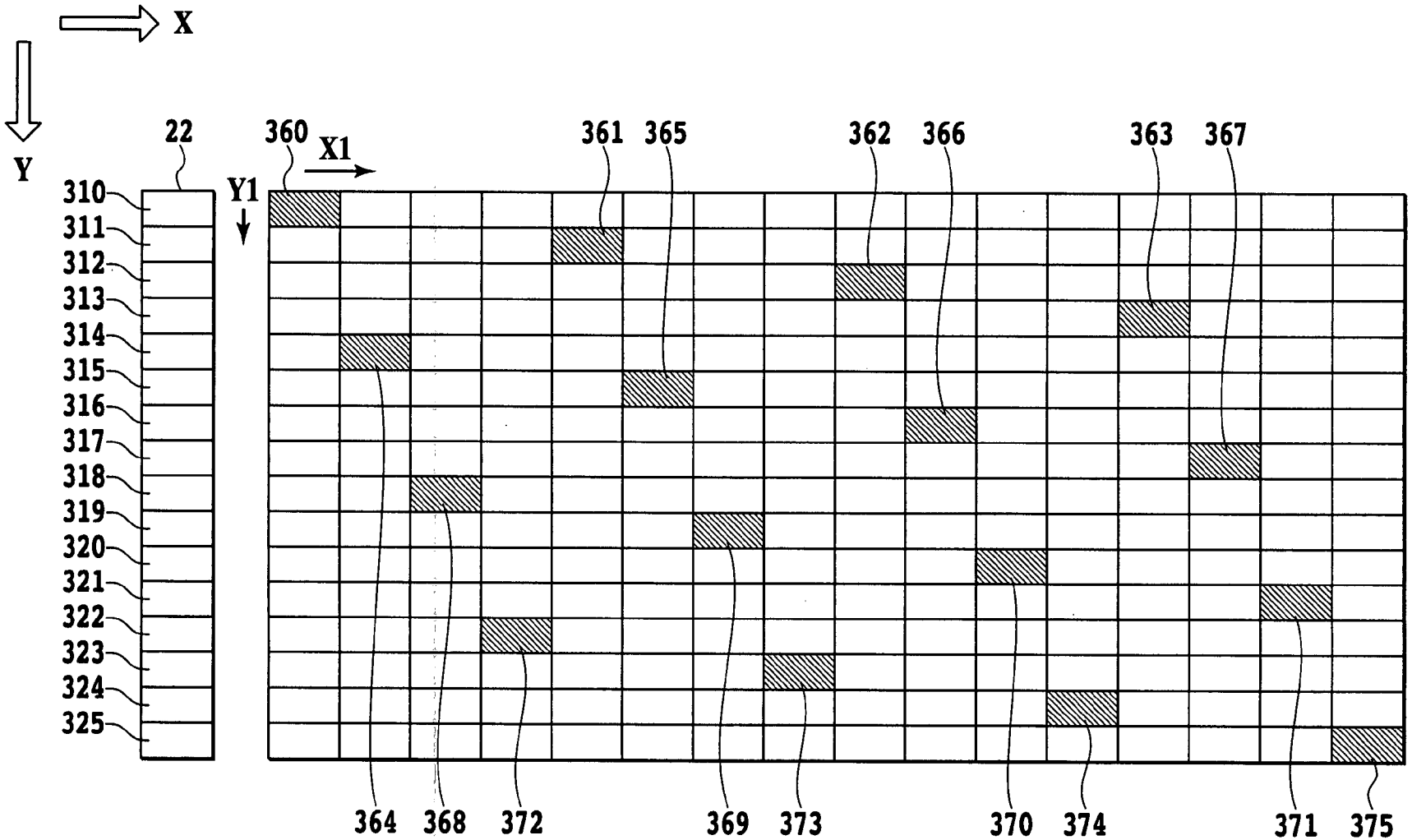
FIG. 7 is a diagram showing the printing data for paper preliminary ejection added in the embodiment of the present invention, through a pattern of pixel arrangement.
Figure 8A:
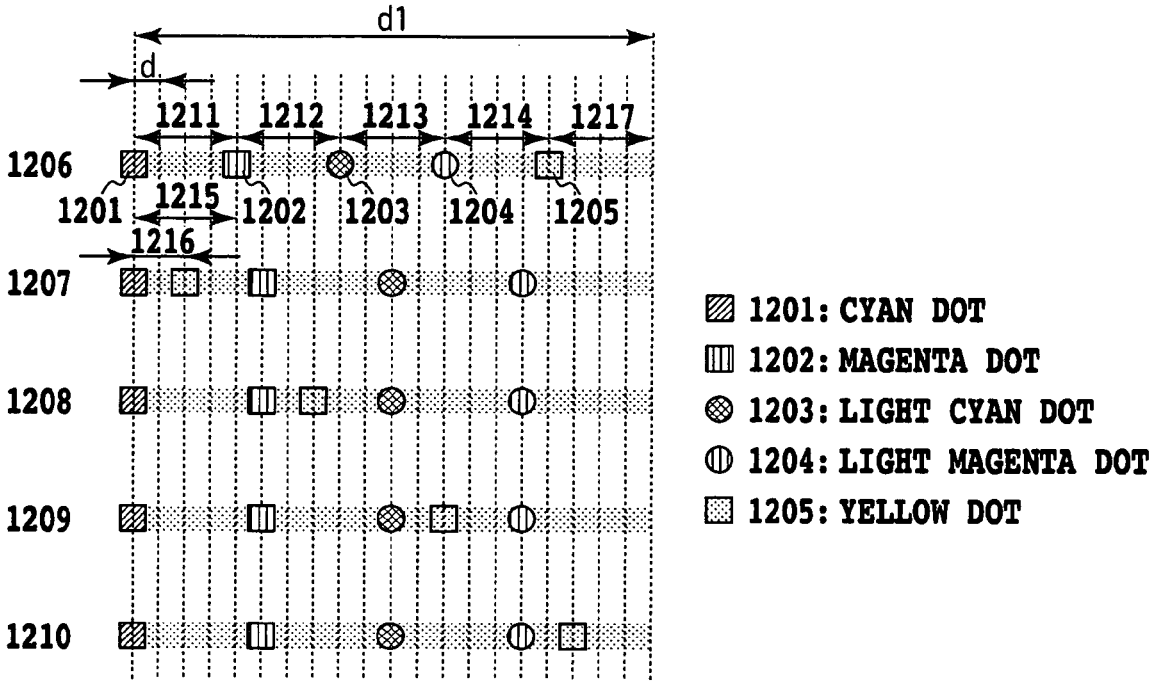
FIGS. 8A, 8B and 8C are diagrams showing patterns of paper preliminary ejection according to a first embodiment of the present invention, through arrangements of dots, which are formed by the preliminary ejection, with respect to pixels.
Figure 8B:
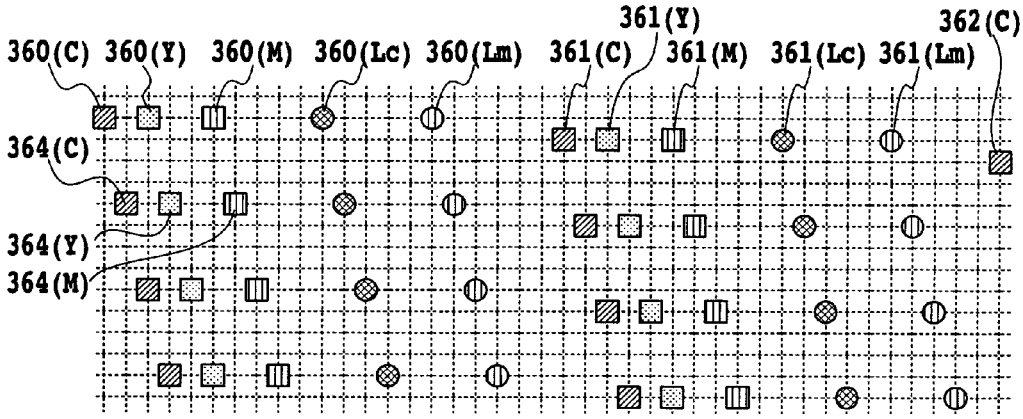
Figure 8C:
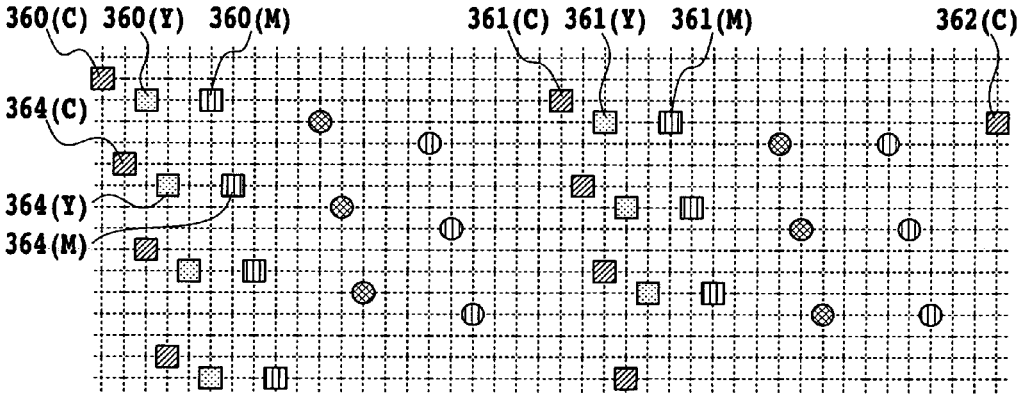

FIG. 7 is a diagram showing printing data of the paper preliminary ejection to be added through a data pattern arranged in the pixel. The pattern of this FIG. 7 shows a basic pattern for an ink of one color, and the combination of preliminary ejection patterns of respective colors of ink is shown by FIGS. 8A-8C and so on. It should be appreciated that the number of ejection orifices in the printing head is set to 16, less than the reality, to simplify the description and reference signs 310 to 325 of the printing head 22 represent 16 respective ejection orifices. Further, the resolution of the paper preliminary ejection pattern is equal to that of the binary data and, in the present embodiment, the resolution in Y direction is supposed to be 1200 dpi, equal to the resolution of the printing head, and also 1200 dpi in X direction.

In FIG. 7, one square represents a pixel corresponding to density of 1200 dpi×1200 dpi. Adjacent Pixels shown in the X direction are separated by X1 pixels, and, adjacent pixels in the Y direction are separated by Y1 pixels. In the present embodiment, X1=75 and Y1=1. Therefore, in FIG. 7 pixels are omitted to be shown only in the X direction.

Reference numeral 360 represents the original point (X0, Y0) of the target pixel. In the case of forming an additional dot of preliminary ejection to this target pixel, ink ejection from an ejection orifice 310 will be applied. The pixel of coordinates (X0+4×X1, 1) gained by shifting by 4×X1 pixels in the X direction and 1 pixel in the Y direction from the original point 360 is a target pixel 361 to which ink from the ejection orifice 311 is applied. As mentioned above, X1 pixel corresponds to 75 pixels. Consequently, the target pixel 360 and the target pixel 361 are separated by 300 pixels (=4×X1 pixels) in the X direction. Similarly, the pixel of coordinate (X0+2×4×X1, 2) gained by shifting by 4×X1 pixels in the X direction and 1 pixel in the Y direction from the target pixel 361 to which ink is added by the ejection orifice 311 is a target pixel 362 to which ink from the ejection orifice 312 is applied. Further, the pixel of coordinate (X0+3×4×X1, 3) gained by shifting by 4×X1 pixels in the X direction and 1 pixel in the Y direction from the target pixel 362 is a target pixel 363 to which ink from the ejection orifice 313 is applied. In the pattern, when becoming Y0+3=Y1−1, the target pixel 364 to which ink from the ejection orifice 314 is added is repeated as (X0+X1, Y1). Thus, pixels in which ink is ejected for preliminary ejection can be determined all over the printing area, by repeating a paper preliminary ejection pattern of a size of 16×X1 pixels in the X direction and 16×Y1 pixels, which is a pattern unit for performing paper preliminary ejection to all of 16 ejection orifices, for the ink of one color. In the present embodiment, the unit of paper preliminary ejection pattern is a size of 1200 pixels in the X direction and 16 pixels in Y direction.

This pattern decision takes into account of the interval of pixels to be applied mutually by the ink color as described below in FIGS. 8A to 8C and so on. In addition, the pattern of paper preliminary ejection can be described with four parameters of original point X0, Y0, distances X1 and Y1 between dots, for each color. Obviously, the aforementioned pattern of paper preliminary ejection is an example, parameters of other forms may also be used for realizing other patterns of paper preliminary ejection, and, a pattern may be expressed without using parameters.

First Embodiment

FIGS. 8A to 8C are diagrams showing patterns of paper preliminary ejection according to a first embodiment of the present invention through dot arrangements formed by ink ejection in pixels. In this embodiment, the preliminary ejection is performed based on the basic pattern of FIG. 7 for respective colors, and such basic patterns are arranged offset so as not to overlay for respective colors, as shown in FIGS. 8A to 8C. To simplify the description, these drawings show the preliminary ejection pattern of inks except for that of black, among patterns of paper preliminary ejection in the ink jet printer which prints by using ink of respective colors: cyan (C), magenta (M), yellow (Y), light cyan (LC), light magenta (LM) and black (K).

Here, FIGS. 8A to 8C show patterns of paper preliminary ejection in the case that in a printing head where ejection orifice rows of respective ink colors are arranged at the same level in the main scanning direction with an interval of 1 cm as shown in FIG. 3, one ejection orifice corresponding to one direct line along the main scanning direction for respective inks scans at scanning speed of 25 inch/sec and ejects at ejection frequency of 25 Hz. One ejection orifice performs one preliminary ejection every 1 inch and, considering that the printing resolution of the present embodiment is 1200 dpi, for one ejection orifice, the preliminary ejection is performed once every 1200 pixels.

The width d1 shown in FIG. 8A corresponds to 300 pixels. This is equal to the width of "4×X1" in the X direction of the basic pattern in FIG. 7. It should be appreciated that the width of "d", distance between two vertical dotted lines, corresponds to 15 pixels, because the width d1 corresponds to 300 pixels.

Here, FIG. 8A shall be described in detail. Dots of respective colors shown in FIG. 8A represent dots formed in the original pixel 360 of the basic pattern shown in FIG. 7, and the positions of the original pixels 360 are offset for respective colors. For instance, taking a pattern 1207 of FIG. 8A as an example, the yellow dot is offset by 30 pixels to the cyan dot. Similarly, magenta dot, light cyan dot, light magenta dot are also offset by 75 pixels, 150 pixels and 225 pixels respectively to the cyan dot.

In FIG. 8A, a pattern 1206 shows a conventional pattern where dots of respective ink colors are arranged equally spaced, as a comparative example, while patterns 1207 to 1210 show different patterns according to the present embodiment from each other. That is, in the present embodiment, the paper preliminary ejection is performed according to any one of patterns 1207 to 1210.

The conventional pattern 1206 is a pattern for arranging dots equidistant (distance 1211=distance 1212=distance 1213=distance 1214) independently of the color. That is, distance 1211 between cyan dot 1201 and magenta dot 1202, distance 1212 between magenta dot 1202 and light cyan dot 1203 and distance 1213 between light cyan dot 1203 and magenta dot 1204, that is, distance between relatively low-lightness colors of dot is set equal to the distance 1214 between these low-lightness colors of dot (light magenta in the pattern 1206) and the yellow dot 1205, which is relatively high-lightness color. Consequently, the distance between low-lightness colors becomes so short that dots of relatively low-lightness colors may be perceived as a group of collected dots in the printed image, thereby causing a granular feeling or the like and deteriorating the quality.

On the other hand, the pattern of the present embodiment, as shown in the pattern 1207 as one example of the embodiment, is determined so that the distance between relatively low-lightness colors, namely cyan dot 1201 and magenta dot 1202, is longer than the distance 1216 between the yellow dot 1205, relatively high-lightness color, and the cyan dot 1201 nearest to the yellow dot among low-lightness dots. Furthermore, the distance between the light magenta dot 1204 positioned at the rightmost end of one pattern unit existing in the range of the distance d1 and the cyan dot 1201 positioned at the leftmost end of the following pattern unit is set approximately equal to the distances between colors of dots from which the yellow dot is excluded. More specifically, the pattern shown in FIG. 8A corresponds to the width of "4×X1" shown in FIG. 7 and an interval between dots formed by the preliminary ejection from the same ejection orifice corresponds to 1200 pixels. Therefore, regarding dots formed on the same raster, a right side pixel area of the rightmost end dot of the pattern unit 1207 shown in FIG. 8A has an area of 900 pixels or more on which dots are not formed by the paper preliminary ejection. However, on the raster shifted from the pixel 360 of FIG. 7 at a distance corresponding to Y1 pixel, the dot is formed on a position shifted from a column of the pixel 360 by a distance corresponding to 300 pixels. According to the above discussion, it is appreciated that on a position shifted by 75 pixels in the X direction and 1 pixel in the Y direction from the light magenta dot 1204 positioned at the rightmost end of the pattern 1207 of FIG. 8A, the cyan dot is formed. Thus, a distance between the light magenta dot 1204 in the pattern 1207 and the leftmost cyan dot 1201, which is positioned on the raster shifted by 1 pixel from the raster of the above light magenta dot 1204 in the Y direction and belongs to the next pattern unit, is approximately equal to the distances between colors of dots from which the yellow dot 1205 is excluded.

Then, for the whole printing, the pattern of the paper preliminary ejection is so created under the relation of dots of other colors and this pattern 1207 that dots of respective colors repeat the basic pattern within the range of the distance d1 as mentioned before in FIG. 7. Thereby, basically, the distance between low-lightness colors of dots can be set longer, and a pattern that can prevent from being perceived as a group of collected dots as mentioned above can be designed easily. That is, when a pattern is designed under the condition to arrange dots of five colors in a range (similar range also in a direction orthogonal to this direction) of the same length d1, as shown in FIG. 8A, the pattern of the present embodiment allows setting longer the interval between less lightness colors of dots. The distance d1 under the above condition can be determined as length, for instance when printing is performed on the A3 format printing paper, by obtaining the preliminary ejection quantity (the number of times of ejection) necessary for one scanning for one color of ink from the viscous property, the scan speed of the ink, and the like and dividing the width in the scan direction of the A3 format printing paper by this number of times of ejection. The printing can be performed without deteriorating the printing quality by the paper preliminary ejection, because the formation of dots that would be perceived as a group of collected dots, by using the aforementioned pattern of preliminary ejection.

A pattern 1208, another example of patterns of the present embodiment, sets the low-lightness dot nearest the yellow dot 1205 as magenta 1202. Similarly, the pattern 1209, still another example, sets the low-lightness dot nearest the yellow dot 1205 as light cyan dot 1203, and the pattern 1210 sets the low-lightness dot nearest the yellow dot 1205 as light magenta dot 1204.

Though the arrangement of black ink dots is not described in the above examples, it is evident from the foregoing that a black dot, taken as a low-lightness color dot, can also be set as a pattern of six colors of ink, making the distance relation with the yellow dot same as dots of other low-lightness colors.

Though only the position of the original pixel 360 in the basic pattern of FIG. 7 is shown in FIG. 8A, naturally, the preliminary ejection is performed also for the other pixels 361 to 375. There, the preliminary ejection position of respective colors based on the basic pattern of FIG. 7 is shown not only for the original pixel but also for the other pixels, in FIGS. 8B and 8C. It should be appreciated that the distance of one square in the X direction corresponds to 15 pixels and the distance of one square in the Y direction corresponds to 1 pixel in FIGS. 8B and 8C. Also, pixel numbers given in FIG. 7 are invoked, in order to clarify the correspondence relation with the basic pattern of FIG. 7. To be specific, preliminary ejection patterns of cyan are indicated by 360(C), 361(C), 362(C) and so on, similarly, preliminary ejection patterns of magenta are indicated by 360(M), 361(M), 362(M) and so on, preliminary ejection patterns of yellow are indicated by 360(Y), 361(Y), 362(Y) and so on, preliminary ejection patterns of light cyan are indicated by 360(Lc), 361(Lc) and so on, and preliminary ejection patterns of light magenta are indicated by 360(Lm), 361(Lm) and so on.

FIG. 8B shows a case where the basic pattern of FIG. 7 is applied to respective color patterns indicated by 1207 in FIG. 8A. To be more specific, the preliminary ejection pattern of yellow is offset by 30 pixels in the X direction, with respect to the preliminary ejection pattern of cyan taken as reference, the preliminary ejection pattern of magenta by 75 pixels in the X direction, the preliminary ejection pattern of light cyan by 150 pixels in the X direction, and the preliminary ejection pattern of yellow by 225 pixels in the X direction. On the other hand, in FIG. 8C, the preliminary ejection pattern of yellow is offset by 30 pixels in the X direction and 1 pixel in the Y direction, with respect to the preliminary ejection pattern of cyan taken as reference, the preliminary ejection pattern of magenta is offset by 75 pixels in the X direction and 1 pixel in the Y direction, the preliminary ejection pattern of light cyan is offset by 150 pixels in the X direction and 2 pixels in the Y direction, and the preliminary ejection pattern of yellow is offset by 225 pixels in the X direction and 2 pixels in the Y direction.

Low-lightness dots for the paper preliminary ejection can be separated as far as possible, by establishing such relation among preliminary ejection positions of respective colors.

Second Embodiment

Figure 9:
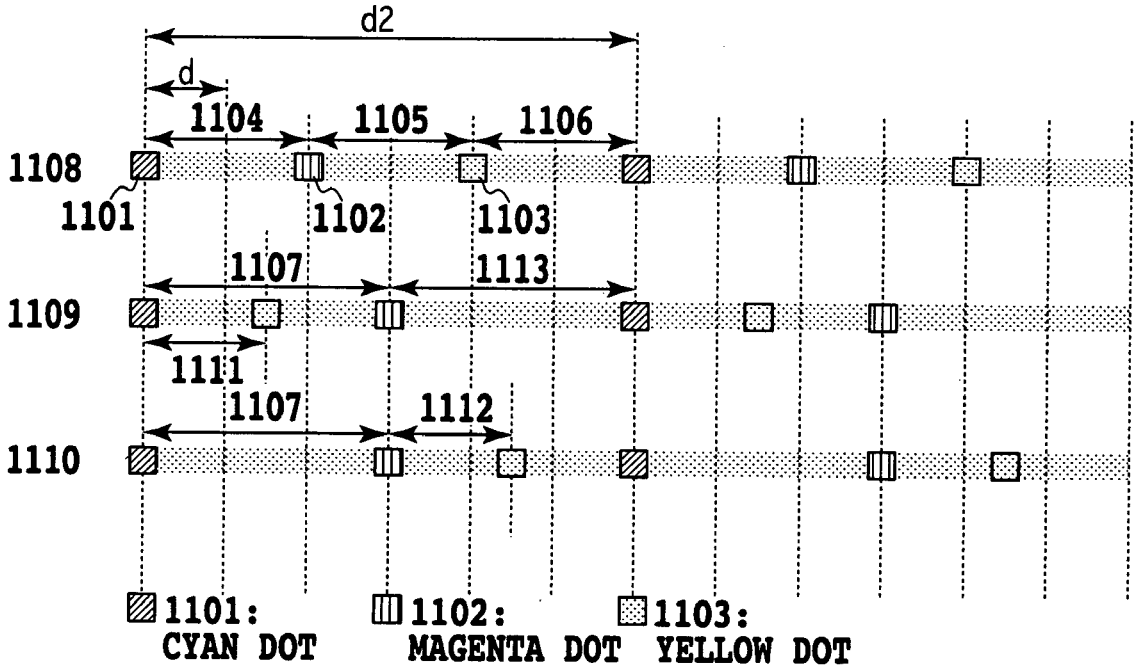
FIG. 9 is a diagram showing patterns of paper preliminary ejection according to a second embodiment of the present invention, through arrangements of dots, which are formed by the preliminary ejection, with respect to pixels.

FIG. 9 is diagram showing a pattern of paper preliminary ejection according to a second embodiment of the present invention through dot arrangements, which are formed by the preliminary ejection, in pixels. The present embodiment relates to the paper preliminary ejection pattern in an ink jet printer where cyan (C), magenta (M), yellow (Y) and black (K) are used as ink and, to simplify the description, FIG. 9 shows the preliminary ejection pattern of ink except for black, similarly to the first embodiment mentioned above. Moreover, as shown in the first embodiment mentioned above, the above pattern shows the paper preliminary ejection pattern in the case where one ejection orifice corresponding to one straight line along the main scan direction for each ink, using a printing head of which ejection orifice rows of respective colors of ink are arranged at the same level in the main scanning direction with an interval of 1 cm, scans with scanning speed of 25 inch/sec and ejects with ejection frequency of 25 Hz. Furthermore, similarly to the first embodiment mentioned above, one ejection orifice performs one preliminary ejection every 1 inch and, considering that the printing resolution of the present embodiment is 1200 dpi, one ejection orifice turns up to perform one preliminary ejection every 1200 pixels.

The width d2 shown in FIG. 9 corresponds to 1200 pixels. This is equal to the width of "16×X1" of the basic pattern unit in FIG. 7. It should be appreciated that the width d, distance between two vertical dotted lines, corresponds to 200 pixels, because the width d2 corresponds to 1200 pixels in FIG. 9.

Here, FIG. 9 shall be described in detail. Dots of respective colors shown in FIG. 9 represent dots formed in the original pixel 360 of the basic pattern shown in FIG. 7, and the position of the original pixel 360 is offset for respective colors. For instance, taking the pattern 1109 of FIG. 9 as an example, the yellow dot is offset by 300 pixels and the magenta dot is offset by 600 pixels to the cyan dot.

In FIG. 9, a pattern 1108 shows a conventional pattern where dots of respective colors of ink are equidistance each other, as a comparative example, while patterns 1109 and 1110 are different patterns according to the present embodiment respectively. That is, in the present embodiment, the paper preliminary ejection is performed according to either pattern 1109 or 1110.

The conventional pattern 1108 is a pattern for arranging dots equidistant (distance 1104=distance 1105) independently of the color. That is, distance 1104 between cyan dot 1101 and magenta dot 1102, is set equal to the distance 1105 between these dots of low-lightness colors (light magenta in this pattern) and the yellow dot 1103, relatively high-lightness color. Consequently, the distance between low-lightness colors becomes so short that dots of relatively low-lightness colors are perceived as a group of collected dots in the printing image, thereby causing sometimes a granular feeling or the like. Incidentally, in the pattern in which distances among each dot are equidistance, even if the magenta dot 1102 of low-lightness color is arranged at the rightmost end of the pattern unit and the yellow dot 1103 is arranged in the middle, the cyan dot 1101 comes at the leftmost end of the next pattern unit, thus the mutual distance (1106) between their dots is equal to the above distance 1104 (1105). Therefore, as shown in the above, distances among low-lightness colors can become such a short distance that dots of relatively low-lightness colors in the printed image can be perceived as a group of collected dots.

On the other hand, in the pattern of the present embodiment, with the pattern 1109 as an example thereof, the distance 1107 between cyan dot 1101 of relatively low-lightness color and magenta dot 1102 is longer than the distance 1111 between the yellow dot 1103 of relatively high-lightness color and the cyan dot 1101 nearest to the yellow dot among low-lightness colors. More specifically, when a pattern is designed under the condition to arrange dots of three colors in a range (similar to a direction orthogonal to this direction) of the same length d2, as shown in FIG. 9, the pattern of the present embodiment allows to set longer the interval between less lightness colors than the conventional pattern 1108. And, the distance 1113 to the cyan dot 1101 at the leftmost end in adjacent pattern units is also set equal to the long distance 1107. The printing can be performed without deteriorating the printing quality by dots of the paper preliminary ejection, by using such patterns of preliminary ejection.

In a pattern 1110, another example of patterns of the present embodiment, a low-lightness dot nearest the yellow dot 1103 is set as magenta dot 1102.

Third Embodiment

In the aforementioned first and second embodiments, preliminary ejection patterns are described in the case where the quantity (the number of times of ejection) of ink of respective colors is the same in paper preliminary ejection, while the present embodiment relates to a preliminary ejection pattern in the case where the quantity (the number of times of ejection) is differentiated according to the ink color.

Figure 10:
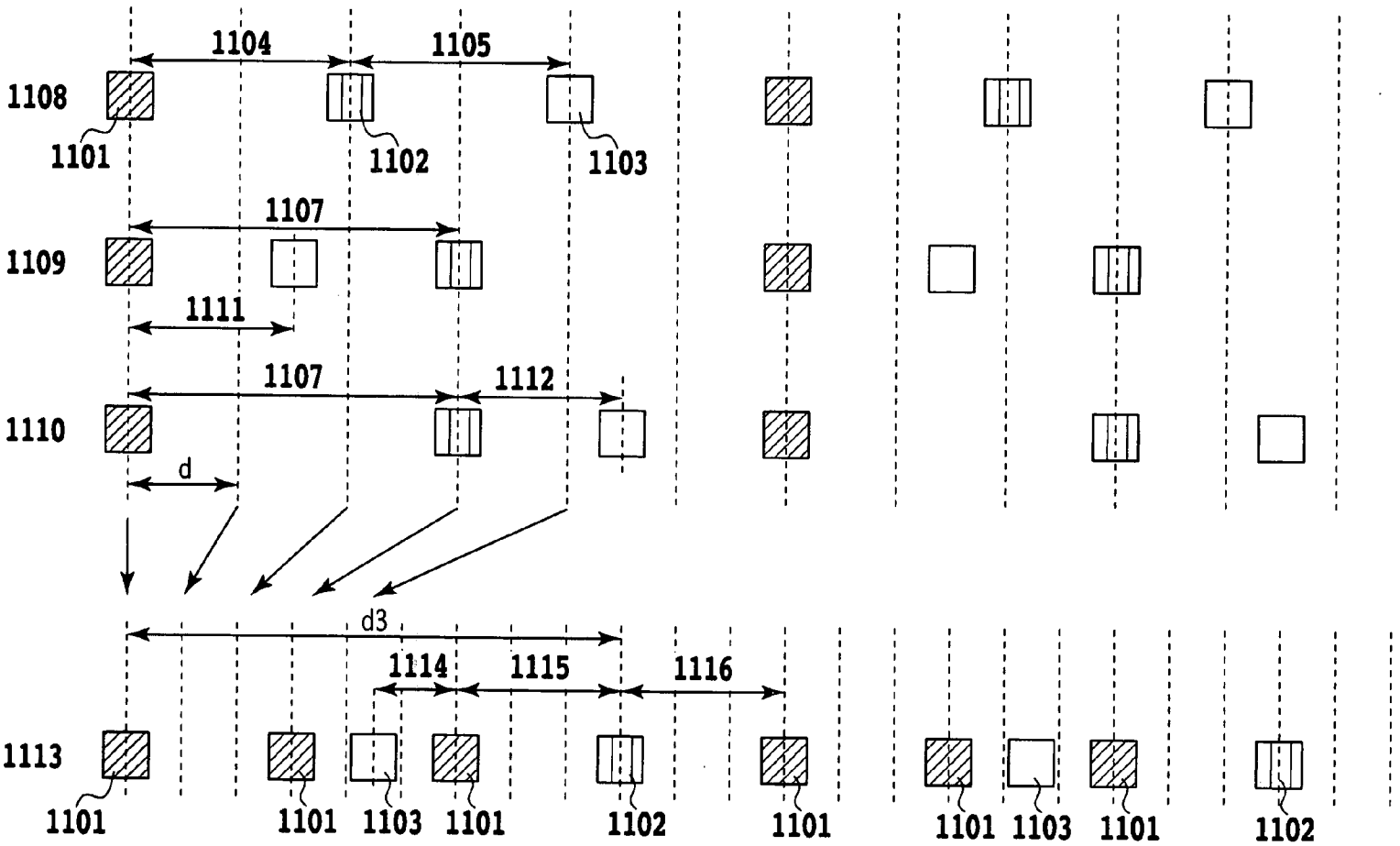
FIG. 10 is a diagram showing patterns of paper preliminary ejection according to a third embodiment of the present invention.

FIG. 10 is a diagram showing a pattern of paper preliminary ejection according to a third embodiment of the present invention. The pattern of the present embodiment shows a pattern of the case where the quantity of preliminary ejection of cyan (C) ink can be more than those of the other colors of ink, and, as a whole the quantity of preliminary ejection of magenta and yellow inks can be reduced. More specifically, compared to the aforementioned second embodiment, a pattern where three cyan dots, one magenta dot and one yellow dot respectively are arranged as a pattern unit in a range of a distance d3 which is larger than the distance d2.

As shown in the same drawing, the pattern 1113 is a pattern wherein the shortest distance 1115 among distances between cyan dot 1101 of relatively low-lightness and magenta dot 1102 is longer than the distance 1114 between the relatively high-lightness yellow dot 1103 and the cyan dot 1101 nearest the yellow dot among low-lightness colors. Also, the distance 1116 to cyan dot 1101 at the leftmost end of the adjacent pattern unit is also set equal to the long distance 1115. The printing can be performed without deteriorating the printing quality because of dots of the paper preliminary ejection, by using such patterns of preliminary ejection.

Other Embodiments

Though, in the aforementioned respective embodiments, a binary paper preliminary ejection pattern is added to the binarized printing data after the index development, data of the paper preliminary ejection pattern may be added to the printing data of index form. For instance, index data of 4 bits correspond to 2×2 in pixel of 1200 dpi×1200 dpi corresponding to the binary printing data. From this fact, these index data are the ones where the position thereof is homologized taking 2 pixels×2 pixels as one unit, in a dot pattern per a pixel shown in FIGS. 8A to 8C and so on. From this fact, the pattern of paper preliminary ejection can also be composed similarly to determine the dot arrangement described in the aforementioned FIGS. 8A-8C to FIG. 10, taking 2 pixels×2 pixels as one unit.

Figure 11:
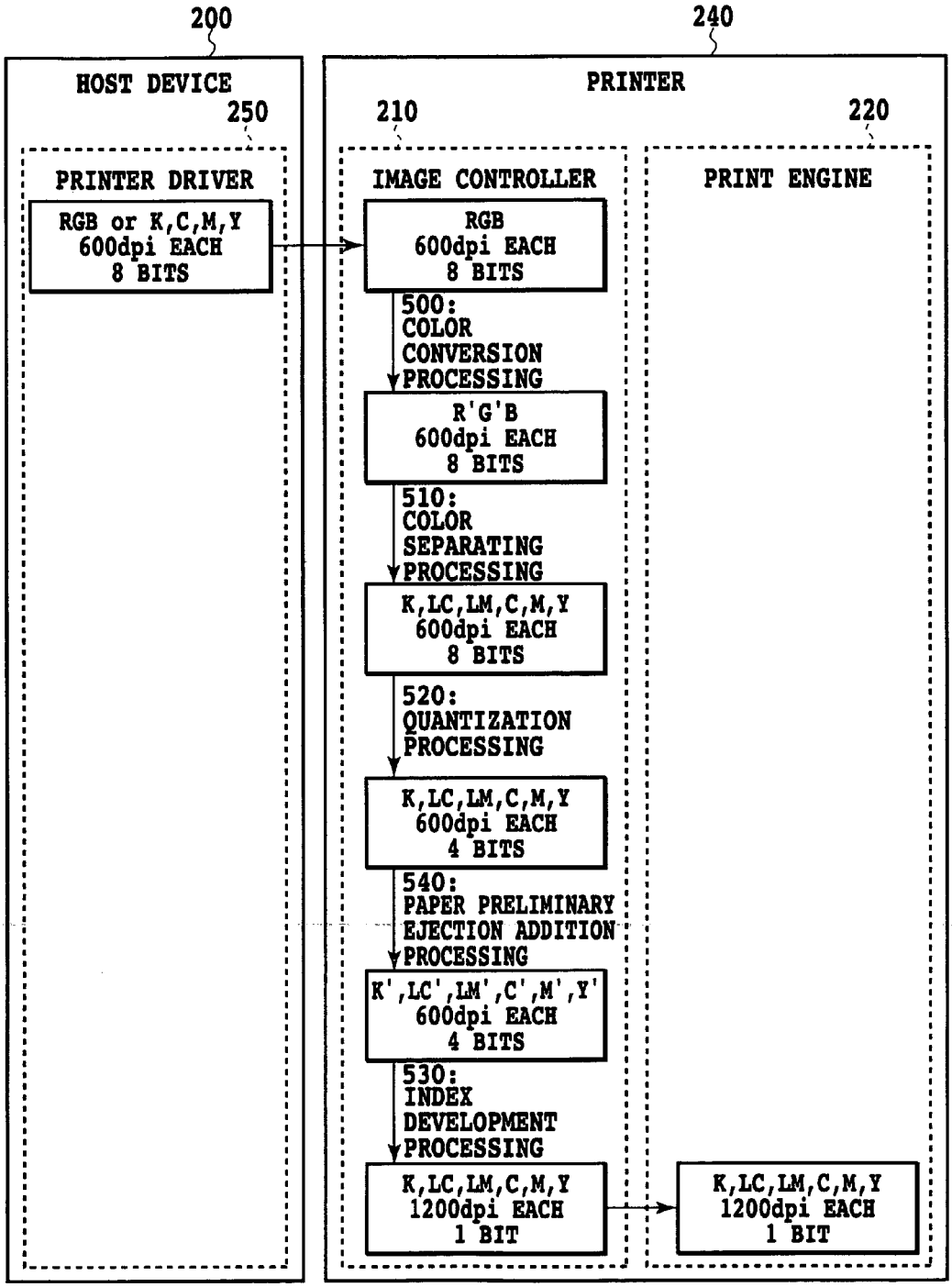
FIG. 11 is a block diagram showing a data processing in the host device 200 and the printer 240, in the case of adding preliminary ejection data of the index form, according to another embodiment of the present invention.

FIG. 11 is a block diagram showing a data processing in the host device 200 and the printer 240, in the case of adding preliminary ejection data of index form, and a similar one to FIG. 5 mentioned above. In short, a similar processing is performed up to the quantization processing 520 of the data transferred from the host device 200 by the printer 240.

A processing 540 for adding a paper preliminary ejection pattern is executed to 4-bit (5 gradation values) data of quantized K, LC, LM, C, M, Y. More specifically, the 4-bit (5 gradation values) data of quantized K, LC, LM, C, M, Y have any one value among "0000", "0001", "0010", "0011", "0100" as described in FIG. 6. If it has the value of "0001", "0010", "0011", "0100", the paper preliminary ejection data are not added, because ink is ejected to the pixel. On the other hand, in the case of "0000", paper preliminary ejection data as shown in FIG. 12 are added.

Then, the printing data to which the preliminary ejection data are added are converted into printing data of 1-bit (2 gradation values) for respective colors of K, LC, LM, C, M, Y and transferred to the printer engine 220 as printing data containing the paper preliminary ejection data.

Figure 12:
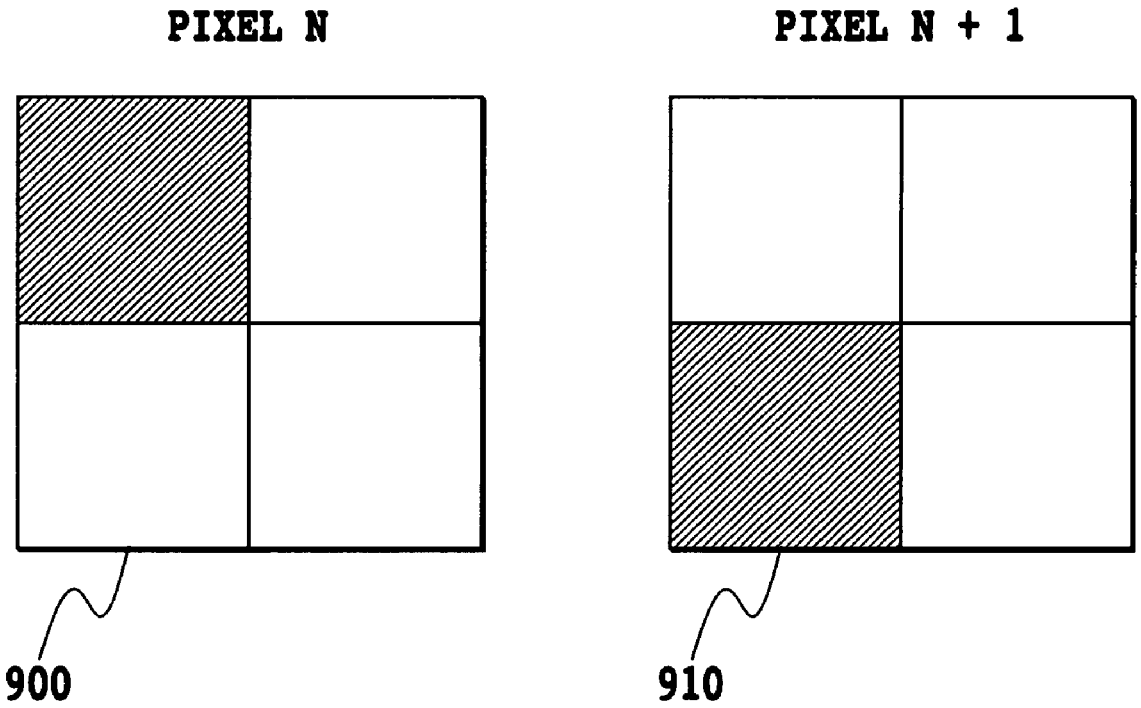
FIG. 12 is a diagram illustrating an index development pattern used for the preliminary ejection.

FIG. 12 is a diagram illustrating an index development pattern used for the preliminary ejection. As shown in the same drawing, two kinds of patterns as shown by pattern 900 and pattern 910 are prepared, as an index development pattern corresponding to 4-bit data of "0001" used as paper preliminary ejection data. It becomes possible to prevent the deflection of the ejection orifice to perform the paper preliminary ejection, by using these two kinds of pattern alternatively.

Figure 13:
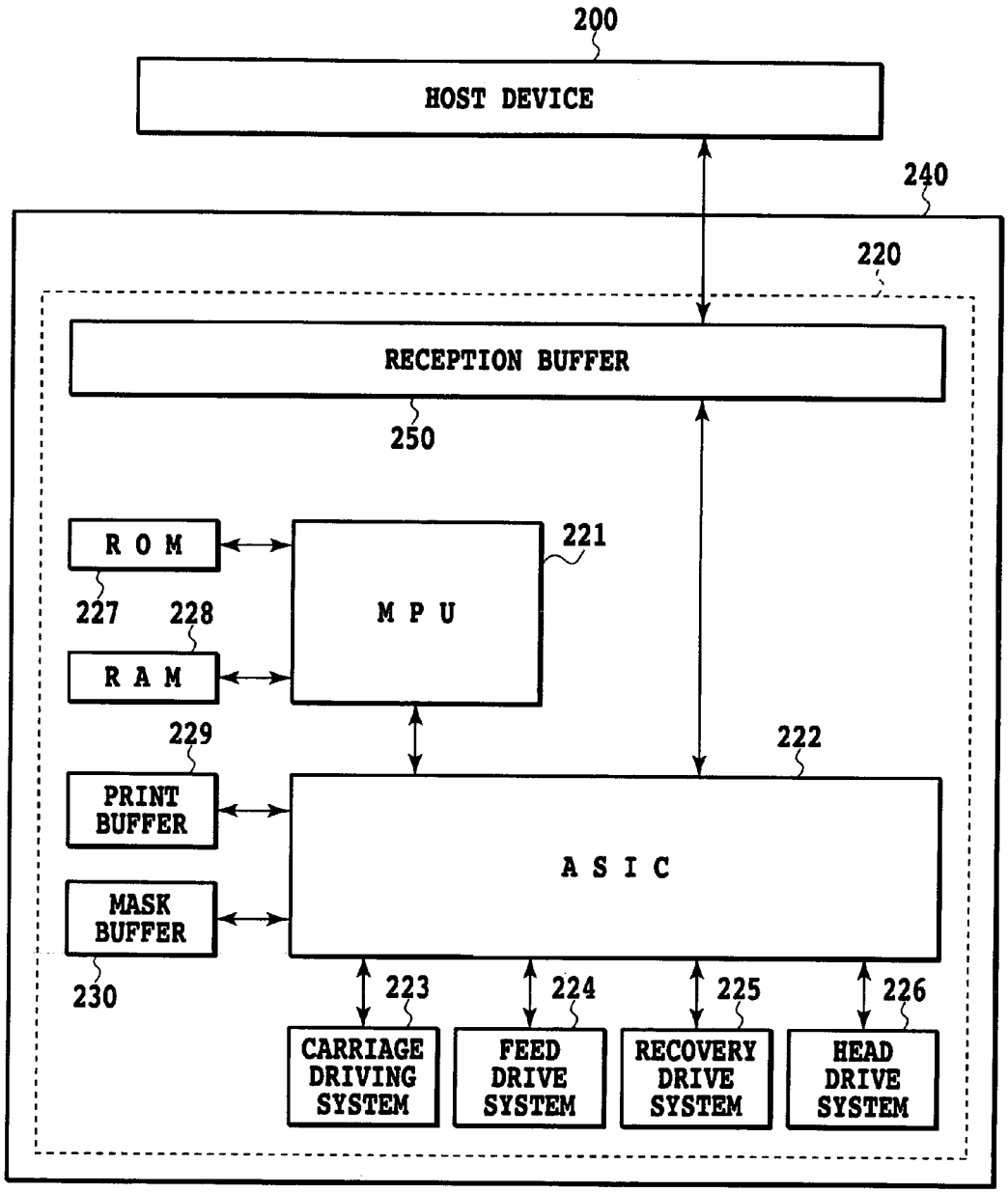
FIG. 13 is a block diagram showing an example of configuration of image processing by a printer driver of the host device, according to still another embodiment of the present invention.

In addition, the present invention can also be applied to a composition for performing image processing in a printer driver of the host device. FIG. 13, similar to FIG. 4, shows an example of the composition. In this case, it is unnecessary for the printer to equip with an image controller for assuming mainly image processing, thereby reducing the cost of the printer.

In this composition, the printing operation starts by sending image data from the host device 200 to a reception buffer 250 of a print engine control section 220. The print engine control section 220 analyses the image data received from the host device 200 and generates information necessary for the printing such as printing data, printing quality, margin information. There, printing data, printing quality, margin information or the like are processed by an MPU 221 through an ASIC 222 and held in a RAM 228. Thereafter, this information is referred to as necessary and used for segmenting the process. Furthermore, the mask pattern is written in a mask buffer 230 as necessary. And, printing data to which the data of paper preliminary ejection are added can be created by taking the OR (logical sum) of preliminary ejection data which are preliminarily generated and the above, as printing data.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications.

This application claims priority from Japanese Patent Application No. 2004-177373 filed Jun. 15, 2004, which is hereby incorporated by reference herein.

What is claimed is:

1. An ink jet printing method that uses a printing head for ejecting a plurality of colors of ink on a printing medium to perform printing, in which the plurality of colors of ink are ejected on the printing medium for preliminary ejection in conjunction with ink ejection for the performance of printing, said method comprising:

a step for generating print data by adding preliminary ejection data for the preliminary ejection to print data based on an image to be printed; and a step for ejecting the plurality of colors of ink on the printing medium from the printing head, based on the generated print data, wherein a dot pattern of the plurality of colors of ink formed based on the preliminary ejection data is a pattern having a relation that a distance between any two dots other than a dot of highest-lightness is longer than a distance between a dot nearest to the dot of highest-lightness and a dot of highest-lightness, among the plurality of colors of dots.

2. An ink jet printing method as claimed in claim 1, wherein a pattern unit, which is formed with the plurality of colors of dots and has the relation, is repeated in a same direction as an arrangement direction of the plurality of colors of dots.

3. An ink jet printing method as claimed in claim 2, wherein a distance between respective dots nearest to each other in the adjacent pattern units is longer than the distance between the dot nearest to the dot of highest-lightness and the dot of highest-lightness.

4. An ink jet printing method as claimed in claim 2, wherein the pattern unit, which is formed with the plurality of colors of dots and has the relation, includes a plurality of dots of the same color.

5. An ink jet printing apparatus that uses a printing head for ejecting a plurality of colors of ink on a printing medium to perform printing, in which the plurality of colors of ink are ejected on the printing medium for preliminary ejection in conjunction with ink ejection for the performance of printing, said apparatus comprising:

generating means for generating print data by adding preliminary ejection data for the preliminary ejection to print data based on an image to be printed; and ejection means for ejecting the plurality of colors of ink on the printing medium from the printing head, based on the generated print data, wherein a dot pattern of the plurality of colors of ink formed based on the preliminary ejection data is a pattern having a relation that a distance between any two dots other than a dot of highest-lightness is longer than a distance between a dot nearest to the dot of highest-lightness and a dot of highest-lightness, among the plurality of colors of dots.

6. An ink jet printing apparatus as claimed in claim 5, wherein a pattern unit, which is formed with the plurality of colors of dots and has the relation, is repeated in a same direction as an arrangement direction of the plurality of colors of dots.

7. An ink jet printing apparatus as claimed in claim 6, wherein a distance between respective dots nearest to each other in the adjacent pattern units is longer than the distance between the dot nearest to the dot of highest-lightness and the dot of highest-lightness.

8. An ink jet printing apparatus as claimed in claim 6, wherein the pattern unit, which is formed with the plurality of colors of dots and has the relation, includes a plurality of dots of the same color.

* * * * *

UNITED STATES PATENT AND TRADEMARK OFFICE

CERTIFICATE OF CORRECTION

PATENT NO. : 7,290,858 B2
APPLICATION NO. : 11/150125
DATED : November 6, 2007
INVENTOR(S) : Furuichi et al.

It is certified that error appears in the above-identified patent and that said Letters Patent is hereby corrected as shown below:

COLUMN 2:
Line 51, “step” should read --a step--.
Line 54, “step” should read --a step--.

COLUMN 3:
Line 64, “host-device 200” should read --host device 200--.

COLUMN 4:
Line 38, “as” should read --to as--.

COLUMN 5:
Line 20, “composed” should read --composed of--.
Line 59, “the” should be deleted.

COLUMN 6:
Line 34, “control section” (1st occurrence) should be deleted.
Line 53, “paths, a” should read --paths, and a--.

COLUMN 8:
Line 36, “graduation” should read --gradation--.
Line 59, “Pixels” should read --pixels--.

COLUMN 9:
Line 35, “example, param-” should read --example; param- --.

COLUMN 10:
Line 30, “dot” should read --dots--.
Line 31, “dot” should read --dots--.

COLUMN 11:
Line 43, “same” should read --the same--.

UNITED STATES PATENT AND TRADEMARK OFFICE

CERTIFICATE OF CORRECTION

PATENT NO. : 7,290,858 B2
APPLICATION NO. : 11/150125
DATED : November 6, 2007
INVENTOR(S) : Furuichi et al.

It is certified that error appears in the above-identified patent and that said Letters Patent is hereby corrected as shown below:

COLUMN 12:
Line 62, "each" should read --from each--.

Signed and Sealed this

Tenth Day of March, 2009

JOHN DOLL
*Acting Director of the United States Patent and Trademark Office*